US009957656B2

(12) United States Patent
Jo et al.

(10) Patent No.: US 9,957,656 B2
(45) **Date of Patent: *May 1, 2018**

(54) WASHING MACHINE

(71) Applicant: LG ELECTRONICS INC., Seoul (KR)

(72) Inventors: Mingyu Jo, Seoul (KR); Seungchul Park, Seoul (KR); Dongwon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 79 days.

This patent is subject to a terminal disclaimer.

(21) Appl. No.: 15/048,652

(22) Filed: Feb. 19, 2016

(65) Prior Publication Data

US 2016/0273149 A1 Sep. 22, 2016

(30) Foreign Application Priority Data

Mar. 20, 2015 (KR) ..... 10-2015-0038752
Mar. 20, 2015 (KR) ..... 10-2015-0038753

(51) Int. Cl.

| | |
|---|---|
| ***D06F 37/28*** | (2006.01) |
| ***D06F 37/22*** | (2006.01) |
| ***D06F 39/14*** | (2006.01) |
| *D06F 39/12* | (2006.01) |
| *D06F 37/26* | (2006.01) |

(52) U.S. Cl.

CPC ..... *D06F 37/28* (2013.01); *D06F 37/22* (2013.01); *D06F 39/14* (2013.01); *D06F 37/267* (2013.01); *D06F 39/12* (2013.01)

(58) Field of Classification Search

CPC ..... D06F 37/26; D06F 37/28; D06F 37/267; D06F 37/42; D06F 39/12; D06F 39/14

See application file for complete search history.

(56) References Cited

U.S. PATENT DOCUMENTS 5,398,528 A * 3/1995 Johnston ..... D06F 37/28 68/140
5,437,168 A * 8/1995 Mason ..... D06F 39/14 68/142
5,448,900 A * 9/1995 Cuthbert ..... D06F 37/10 68/139
5,469,593 A * 11/1995 Cuthbert ..... D06F 37/302 68/140

(Continued)

FOREIGN PATENT DOCUMENTS

GB 2360297 A * 9/2001 ..... D06F 39/14
JP 2006-280401 A 10/2006

(Continued)

*Primary Examiner* — Joseph L. Perrin
(74) *Attorney, Agent, or Firm* — Dentons US LLP

(57) ABSTRACT

A washing machine including a cabinet having a first introduction port, a tub, which is provided in the cabinet and which has a second introduction port that is concentrically positioned with respect to the first introduction port, a cabinet door attached to the cabinet to open and close the first introduction port, a tub door attached to the tub to open and close the second introduction port, and a lock-releasing unit, which is attached to the cabinet to release a locked state of the cabinet door and the tub door.

16 Claims, 14 Drawing Sheets

(56) References Cited

U.S. PATENT DOCUMENTS

| | | | | |
|---|---|---|---|---|
| 5,546,772 | A * | 8/1996 | Merlin | D06F 37/10 68/142 |
| 6,233,981 | B1 * | 5/2001 | Grandpierre | D06F 37/10 68/140 |
| 7,013,682 | B2 * | 3/2006 | Sharrow | D06F 37/10 68/12.26 |
| 8,215,135 | B2 * | 7/2012 | Hapke | D06F 37/42 134/57 DL |
| 2008/0223086 | A1 * | 9/2008 | Zardetto | D06F 39/14 68/142 |
| 2011/0120195 | A1 * | 5/2011 | Jeoung | D06F 39/14 68/139 |

FOREIGN PATENT DOCUMENTS

| | | | |
|---|---|---|---|
| JP | 2010-51542 | A | 3/2010 |
| KR | 20-1995-0005184 | Y1 | 6/1995 |
| KR | 10-0452354 | B1 | 10/2004 |
| KR | 10-0534644 | B1 | 12/2005 |
| KR | 10-2007-0063998 | A | 6/2007 |
| KR | 10-2010-0070707 | A | 6/2010 |
| KR | 10-2010-0120046 | A | 11/2010 |
| KR | 10-2011-0057920 | A | 6/2011 |
| KR | 10-2012-0043263 | A | 5/2012 |

* cited by examiner

WASHING MACHINE

CROSS-REFERENCE TO RELATED APPLICATIONS

This application claims the benefit of Korean Patent Application No. 10-2015-0038752 and 10-2015-0038753 filed on Mar. 20, 2015, which are hereby incorporated by reference as if fully set forth herein.

BACKGROUND

1. Field of the Disclosure

The invention relates to a washing machine, and more particularly to a washing machine, which is provided with a door having an improved structure to prevent or substantially reduce vibration and noise generated in a tub from being transmitted to a case while the washing machine is operating.

2. Discussion of the Conventional Art

Generally, a washing machine refers to an electrical household appliance that removes contaminants from laundry by employing the emulsification of detergent, rubbing action and impact action, which are applied to the laundry by water stream generated by the rotation of a pulsator or a drum, and the like.

A fully-automatic washing machine generally refers to a washing machine that automatically performs a series of courses composed of a washing course, a rinsing course, a dehydrating course and the like, without the need for intervening manipulation by a user.

A drum washing machine generally refers to a washing machine that has a reduced overall height compared to a pulsator washing machine; however, during operation, the laundry becomes entangled and a large number of wrinkles are generated.

The structure of a conventional drum washing machine 10, as described above, will be briefly described with reference to the accompanying drawing shown in FIG. 1. As shown in FIG. 1, the conventional washing machine 10 includes a cabinet 11, a tub 13, which is supported inside the cabinet 11 by a damper (not shown) and a spring (not shown) and which contains washing water, and a cylindrical drum 15, which is provided inside the tub 13 to hold laundry and which receives a driving force from the drive unit 17 for washing the laundry held in the drum 15. This washing machine 10 necessarily includes a gasket 19 located between the opening of the tub 13 and the cabinet 11 to prevent washing water contained in the tub 13 from leaking.

When the drum 15 rotates to wash and dehydrate the laundry held therein, 0 generates vibrations attributable to the rotation of the drum 15, eccentric disposition of laundry or the like, and the vibrations generated by the rotation of the drum 15 are transmitted to the outside through the tub 13 and the cabinet 11.

The vibrations and noise transmitted to the tub 13 are transmitted to the cabinet 11 through the gasket 19 maintains a watertight state between the cabinet 11 and the tub 13, which subjects the cabinet 11 to vibrations and noise.

Additionally, in the conventional washing machine 10, laundry may become caught between the door 12 for closing the tub 13 and the drum 15. To prevent laundry from being caught between the door and the drum, the door 12 is constructed such that the inner surface of the door 12 projects toward the inside of the opening of the tub 13 or the drum 15. However, the projecting structure of the door 12 occupies part of the washing volume in the drum 15, thereby reducing the washing capacity of washing machine 10.

SUMMARY OF THE DISCLOSURE

Accordingly, the invention relates to a washing machine that substantially obviates one or more problems due to limitations and disadvantages of the conventional art.

An object of the invention is to provide a washing machine having an improved structure between a tub and a cabinet to prevent vibration or noise generated in the tub from being transmitted to the cabinet through a gasket.

Another object of the invention is to provide a washing machine having an improved internal structure between a tub and a cabinet to increase the capacity of the tub as compared to a conventional washing machine.

Additional advantages, objects, and features of the invention are set forth in the description which follows and will become apparent to those having ordinary skill in the art upon examination of the following description or may be learned from practice of the invention.

According to one embodiment of the invention, a washing machine includes a cabinet having a first introduction port; a tub provided in the cabinet, the tub having a second introduction port that is concentrically positioned with respect to the first introduction port; a cabinet door attached to the cabinet to open and close the first introduction port; a tub door attached to the tub to open and close the second introduction port; and a lock-releasing unit attached to the cabinet to unlock a locked state of the cabinet door and the tub door.

According to another embodiment of the invention, a washing machine includes a cabinet having a first introduction port; a tub provided in the cabinet, the tub having a second introduction port that is concentrically positioned with respect to the first introduction port; a drum rotatably provided in the tub; a cabinet door attached to the cabinet to open and close the first introduction port; a tub door attached to the tub to open and close the second introduction port; a cabinet door lock provided at the cabinet to lock the cabinet door; a tub door lock provided at the tub to lock the tub door; and a lock-releasing unit attached to the cabinet to unlock the cabinet door and the tub door.

It is to be understood that both the foregoing general description and the following detailed description of the invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF EXEMPLARY EMBODIMENTS

Hereinafter, a washing machine according to an embodiment of the invention is described in detain with reference to the accompanying drawings. Reference will now be made in detail to the preferred embodiments of the invention, examples of which are illustrated in the accompanying drawings. Wherever possible, the same reference numbers will be used throughout the drawings to refer to the same or like parts.

Figure 1:
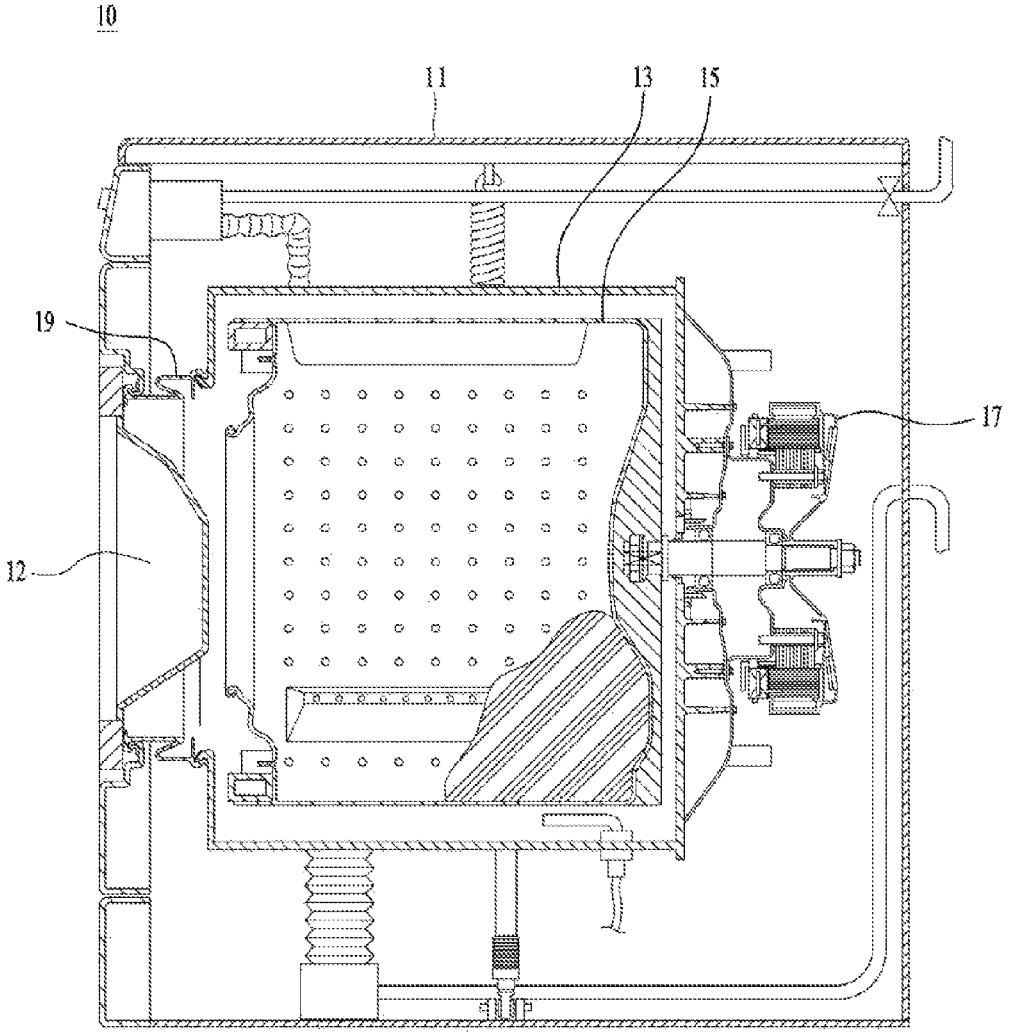
FIG. 1 a schematic view showing a conventional washing machine.
Figure 2:
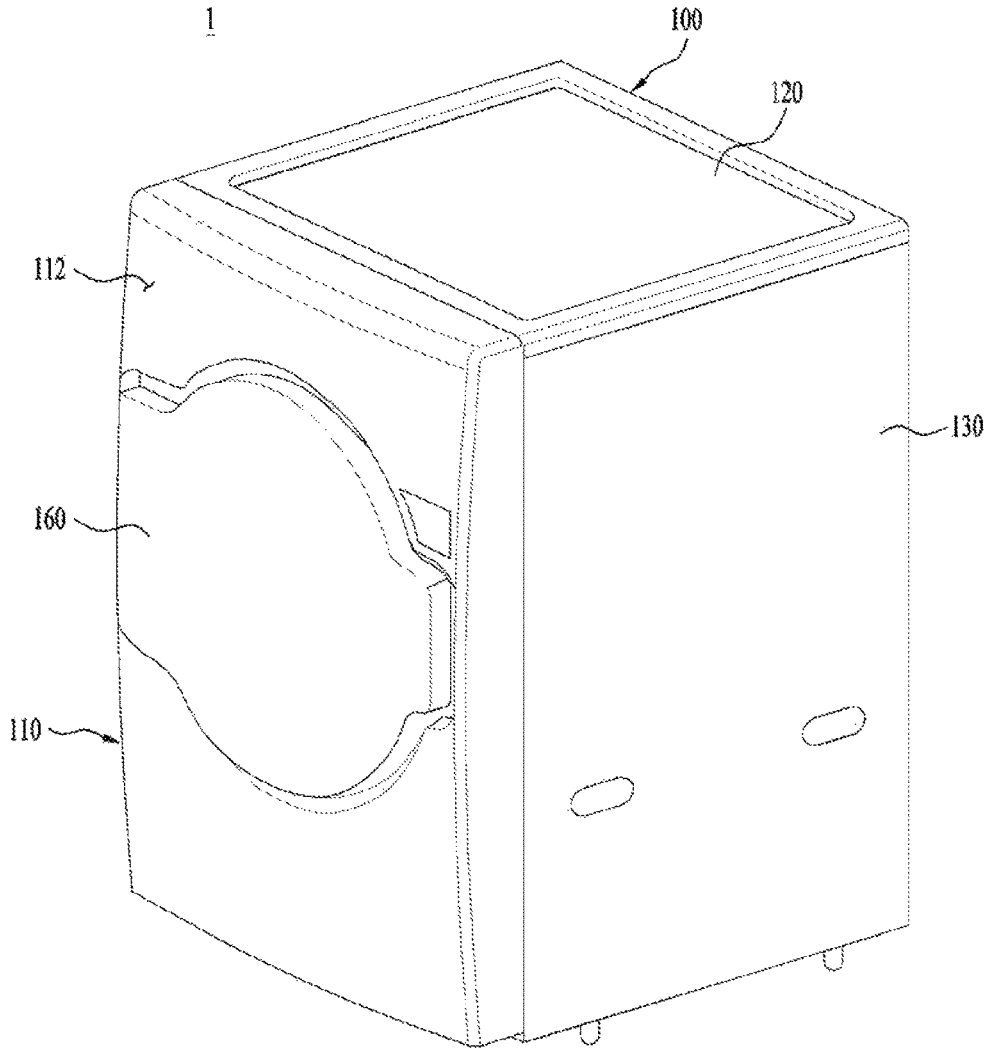
FIG. 2 is a perspective view showing a washing machine according to an embodiment of the invention.
Figure 3:
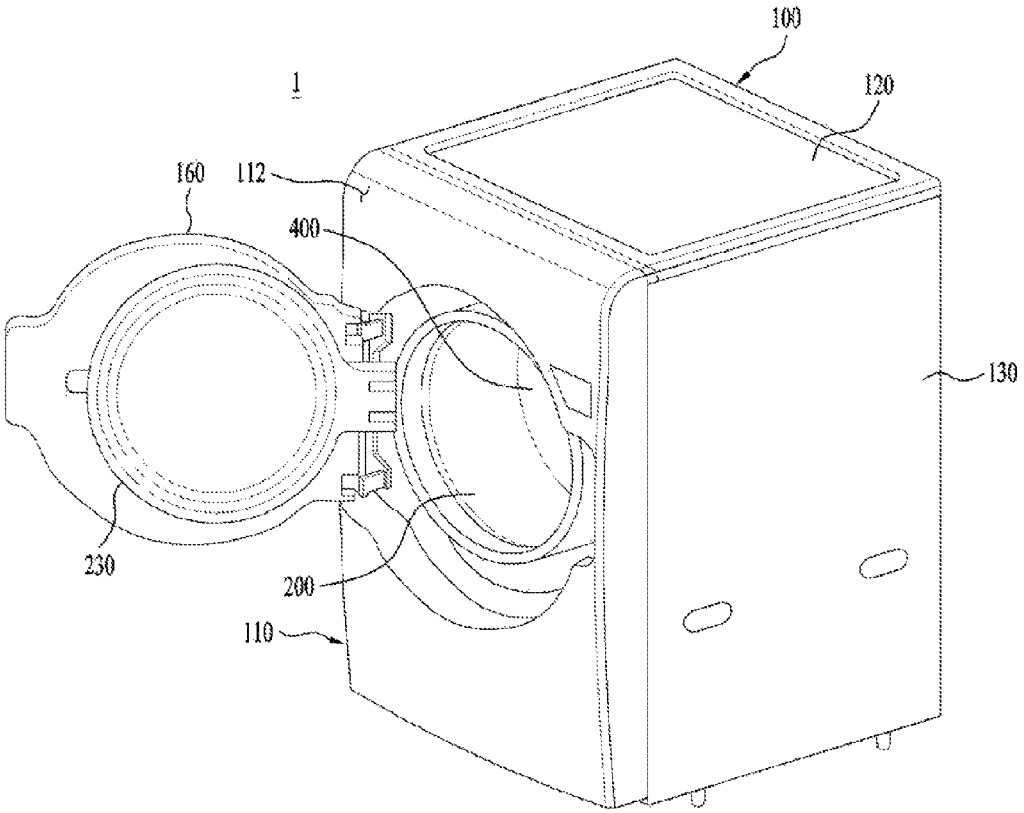
FIG. 3 is a perspective view showing the washing machine according to an embodiment of the invention, in which respective doors are opened.

FIG. 2 is a perspective view showing a washing machine 1 according to the an embodiment of invention. FIG. 3 is a perspective view showing the washing machine according to an embodiment of the invention, in which respective doors are opened.

As shown in FIGS. 2 and 3, includes a cabinet 100, a tub 200, which is supported inside cabinet 100 by a suspension component such as a damper and/or a spring and which holds washing water therein, a drum 400 that is rotatably disposed inside tub 200 to hold laundry therein, and a drive unit (not shown) to rotate drum 400.

Cabinet 100 may include a front cabinet part 110 defining or delineating the front face of, right and left cabinet parts 130 defining or delineating the right and left faces of, and an upper cabinet part 120 defining or delineating the upper face of. Front cabinet part 110 is centrally provided with a first introduction port 114 through which laundry is introduced into the containing space in drum 400. First introduction port 114 is provided with a cabinet door 160 for opening and closing first introduction port 114.

Washing machine 1 may include a control panel 112, which may be provided over the first introduction port 114. The control panel 112 may include a manipulation part and a display part for controlling and displaying the operation of washing machine 1.

Washing machine 1 is provided with a second introduction port 210 in the front of tub 200 so as to allow laundry, which has been introduced in first introduction port 114, to enter drum 400 therethrough. Second introduction port 210 is provided with a tub door 230 to open and close second introduction port 210.

Hereinafter, front cabinet part 110 and tub 200 are described in detail with reference to FIGS. 4 and 5.

Figure 4:
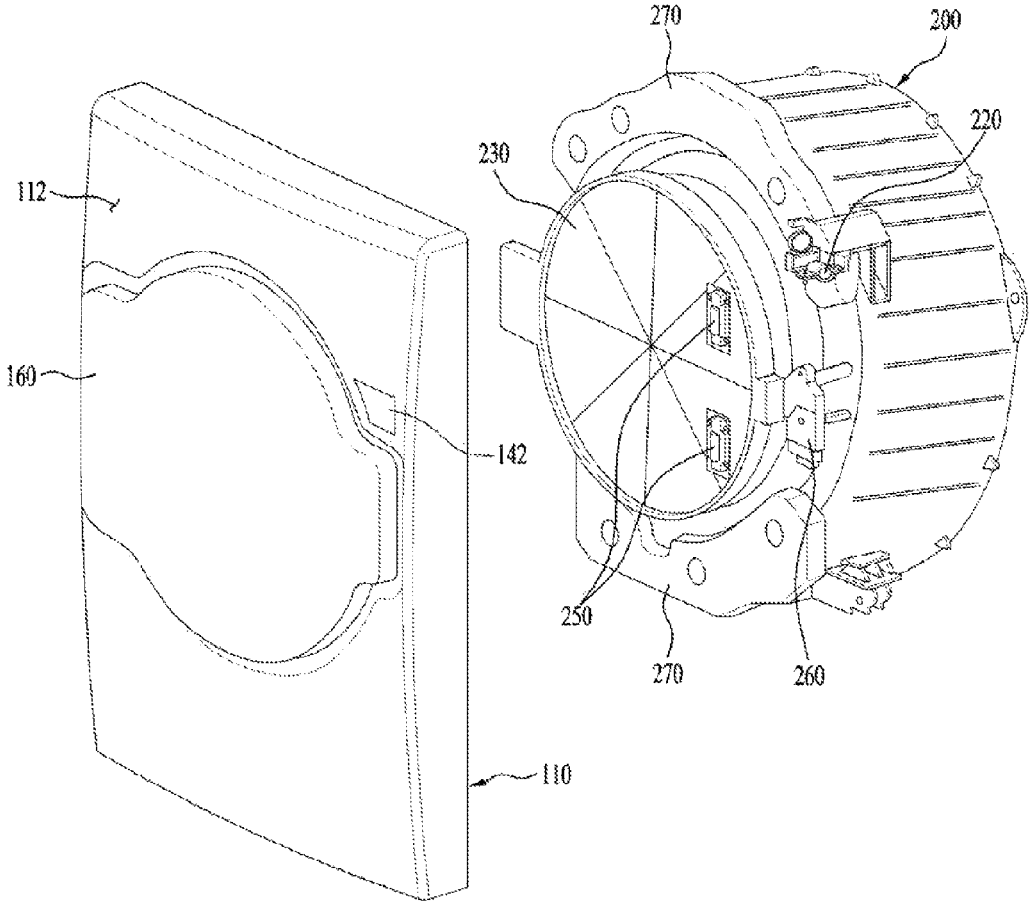
FIG. 4 is a perspective view showing an installation of the cabinet door and the tub door according to an embodiment of the invention.

FIG. 4 is a perspective view showing an installation of cabinet door 160 and tub door 230 according to an embodiment of the invention. FIG. 5 is an exploded perspective view showing the installation of cabinet door 160 and the tub door 230 according to an embodiment of the invention.

Figure 5:
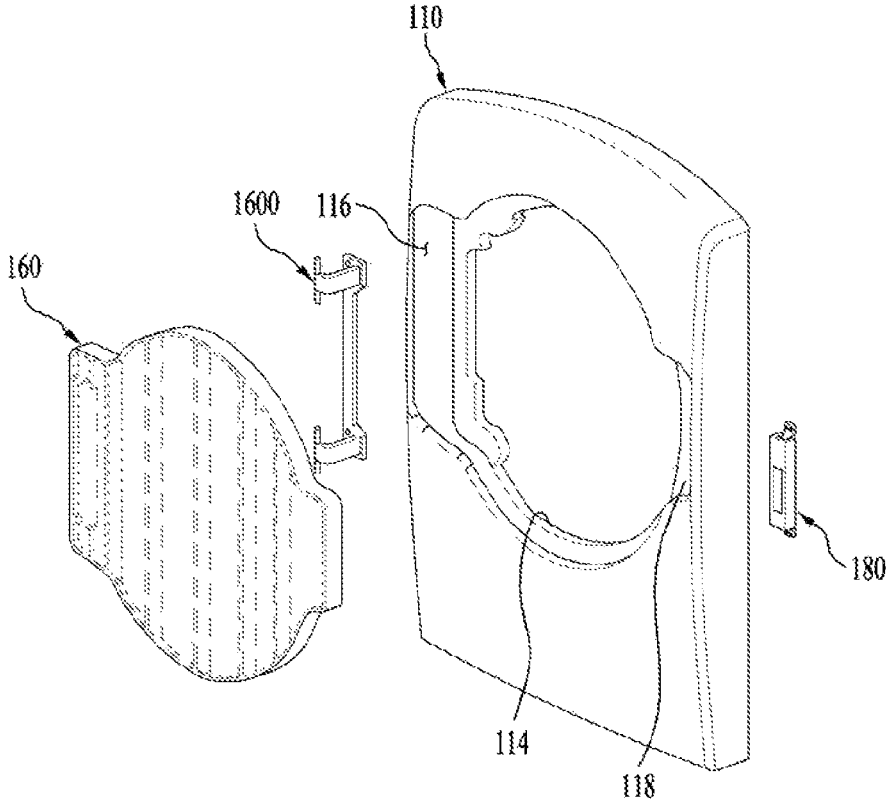
FIG. 5 is an exploded perspective view showing the installation of the cabinet door and the tub door according to an embodiment of the invention.

As shown in FIGS. 4 and 5, front cabinet part 110 includes a cabinet hinge mount 116, which is provided at a side of first introduction port 114 and to which cabinet door 160 is hingedly coupled. Front cabinet part 110 further includes a cabinet door lock mount 118, which is provided at the another side of first introduction port 114, which is opposite cabinet hinge mount 116, so as to set the locked state of cabinet door 160.

Cabinet door lock 180 is mounted in cabinet door lock mount 118 so as not to be exposed to the outside of the cabinet 100 through front cabinet part 110.

A lock-releasing unit 140, which serves to release the locked state of cabinet door lock 180 to control the locked state of front cabinet part 110 and the locked state of tub door lock 260 to control the locked state of tub door 230 (described later), is provided at a lateral side of first introduction port 114.

Lock-releasing unit 140 is constructed to simultaneously release the locked state of cabinet door lock 180 for locking cabinet door 160 and the locked state of tub door lock 260 for locking tub door 230.

Lock-releasing unit 140 may include a push button 142, which is pushed by a user, a cabinet door lock releaser pusher 144, which is moved by push button 142 to actuate a cabinet door lock releaser 150 (described later), and a tub door lock releaser pusher 146, which is moved by push button 142 to actuate a tub door lock releaser 220. Lock-releasing unit 140 will be described below in more detail.

Figure 6:
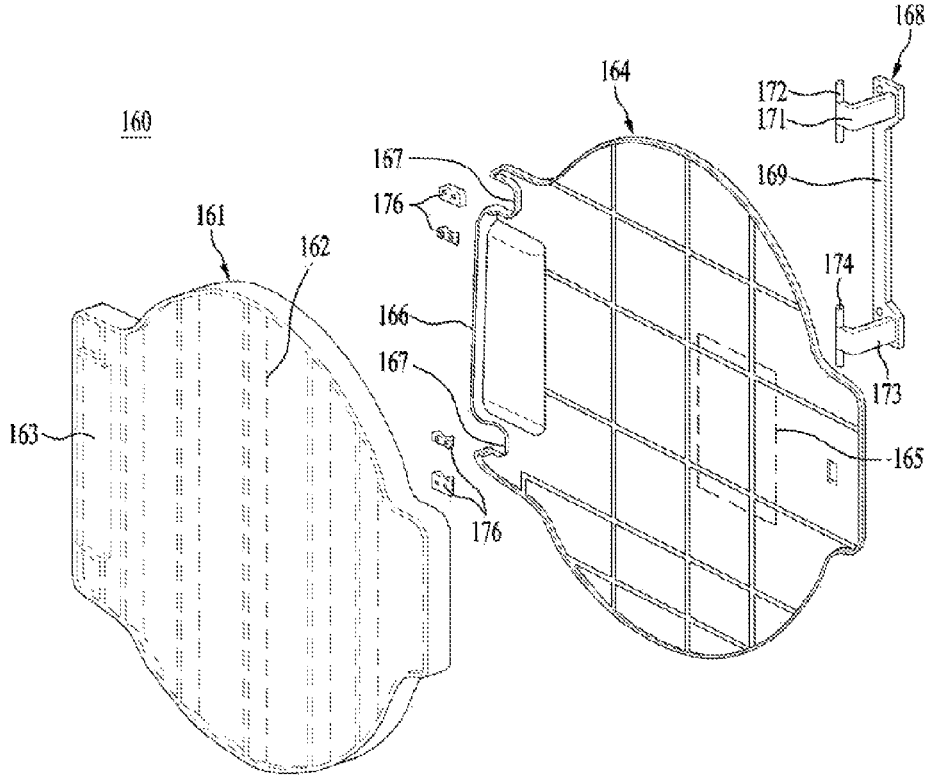
FIG. 6 is an exploded perspective view showing the cabinet door of the washing machine according to an embodiment of the invention.

As shown in FIG. 6, cabinet door 160 is hingedly provided at first introduction port 114 of front cabinet part 110. Cabinet door 160 may include a first outer frame 161, which defines or delineates the outer face of cabinet door 160, and a first inner frame 164, which defines or delineates the inner face of cabinet door 160.

First outer frame 161 and first inner frame 164 may be coupled together by fastening members (not shown) such as bolts, and may be made of a transparent material so that the internal operating condition is visible.

The outer surface of cabinet door 160, which is an outer surface of first outer frame 161, is preferably flush with the surface of front cabinet part 110, and is provided at the inner surface thereof with a plurality of reinforcing ribs 162 for increasing the strength of first outer frame 161.

The inner surface of cabinet door 160, which is an outer surface of first inner frame 164, is provided with a roller-contacting surface 165 with which push rollers 250 of tub door 230 come into contact.

When cabinet door 160 is pushed and closed by a user, roller-contacting surface 165 presses against push rollers 250 of tub door 230 so as to cause tub door 230 and cabinet door 160 to be closed together.

Cabinet door 160 is provided at one side thereof with first hinge unit 168, which is mounted on cabinet hinge mount 116 provided at the periphery of first introduction port 114 to hingedly support cabinet door 160, and is provided at the other side thereof with a cabinet door hook 175, which engages with cabinet door lock 180 to keep cabinet door 160 in the locked state.

First outer frame 161 is provided with a projection 163 on which first hinge unit 168 is mounted, and first inner frame 168 is provided at an area corresponding to projection 163 of first outer frame 161 with a projection 166.

First inner frame 164 is provided above and below projection 166 with a pair of recesses 167 into which upper and lower hinge rods 171 and 173 of first hinge unit 168 are received. Pair of recesses 167, which are provided above and below projection 166, are respectively provided with a pair of brackets 176 for rotatably supporting upper and lower rotating shafts 172 and 174 of first hinge unit 168.

Projection 166, recesses 167 and brackets 176, which are provided at first inner frame 168, are shielded by projection 163 provided on first outer frame 161 from the outside when first outer frame 161 is coupled to first inner frame 168.

First hinge unit 168 includes a hinge body 169, which is coupled to cabinet hinge mount 116 provided at the periphery of first introduction port 114 of the front cabinet part 110, upper hinge rod 171 and lower hinge rod 173 extending from upper and lower portions of hinge body 169, and upper hinge shaft 172 and lower hinge shaft 174, which respectively extend from upper hinge rod 171 and lower hinge rod 173.

Upper and lower hinge rods 171 and 173, which are provided at hinge body 169 of first hinge unit 168, are preferably spaced apart from each other by a predetermined spacing. In order to prevent upper and lower hinge rods 171 and 173 from structurally interfering with a second hinge unit 242 of tub door 230, upper and lower hinge rods 171 and 173 are spaced apart from each other by a predetermined spacing such that second hinge unit 242 is positioned between upper and lower hinge rods 171 and 173.

Cabinet door lock 180, on which the of cabinet door 160 is inserted and locked, is mounted on cabinet door lock mount 118, formed at the other side of first introduction port 114, such that cabinet door lock 180 is disposed inside front cabinet part 110. Cabinet door lock releaser 150, which serves to release the locked state of cabinet door lock 180 together with lock-releasing unit 140, is disposed near first introduction port 114.

Cabinet door lock releaser 150, which is intended to transmit an actuating force applied from lock-releasing unit 140 to cabinet door lock 180 so as to release the locked state of cabinet door lock 180, includes a rotator 152, which is pressed by cabinet door lock releaser pusher 142 provided in lock-releasing unit 140 when push button 142 of lock-releasing unit 140 is pushed, and a tensile cable 154 for transmitting a rotational force of rotator 152 to cabinet door lock 180 in response to rotation of rotator 152.

Figure 7:
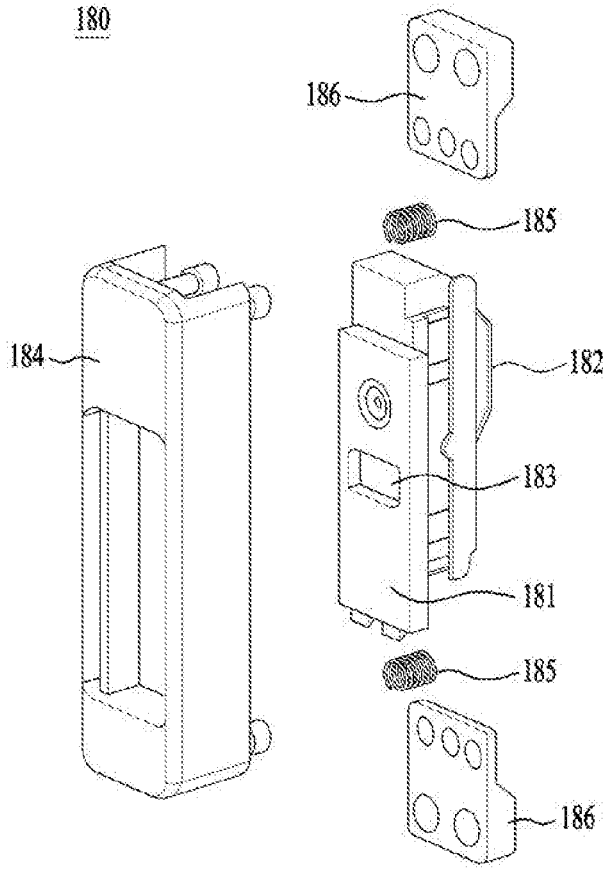
FIG. 7 is an exploded perspective view showing a cabinet door lock of the washing machine according to an embodiment of the invention.

As shown in FIG. 7, cabinet door lock 180, which controls the locked state of cabinet door 160 mounted on first introduction port 114, includes a hook-engaging portion 181 secured in cabinet door lock mount 118 of front cabinet part 110, a cable connector 182, which is disposed near the hook-engaging portion 181 and is connected to the tensile cable 154 of cabinet door lock releaser 150, a hook insert portion 183, which is provided outside cabinet door lock mount 118 and is coupled to hook-engaging portion 181 such that it is movable in a direction in which cabinet door hook 175 is inserted, and an elastic support 184 to elastically support the hook insert portion 183 in a direction opposite to the insertion direction of cabinet door hook 175 by an elastic element such as a spring.

Cabinet door lock 180 further includes an allowance space to allow hook insert portion 183 to be elastically supported by elastic support 184 after cabinet door 160 engages with hook-engaging portion 181 in the course of closing cabinet door 160. Accordingly, after cabinet door 160 is pushed and thus locked on the hook-engaging portion 181 of cabinet door lock 180, cabinet door 160 may be further pushed so as to cause tub door 230 to be closed. The structure for the simultaneous operation of cabinet door 160 and tub door 230 will be described below.

Hereinafter, tub door 230 is described in detail with reference to FIGS. 8 and 9.

Figure 8:
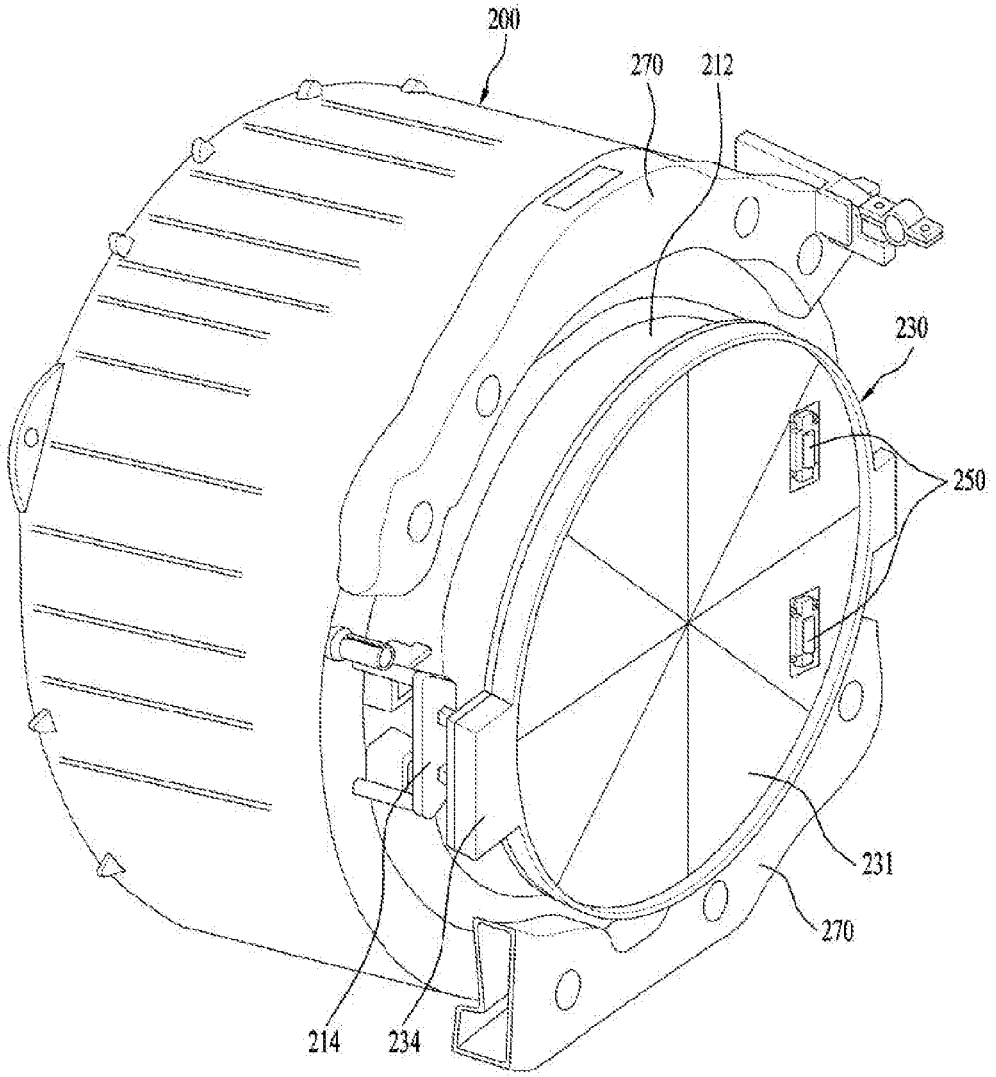
FIG. 8 is a perspective view showing the tub and the tub door of the washing machine according to an embodiment of the invention.

FIG. 8 is a perspective view showing tub 200 and tub door 230 of washing machine 1 according to an embodiment of the invention. FIG. 9 is an exploded perspective view showing tub door 230 of washing machine 1 according to an embodiment of the invention.

Figure 9:
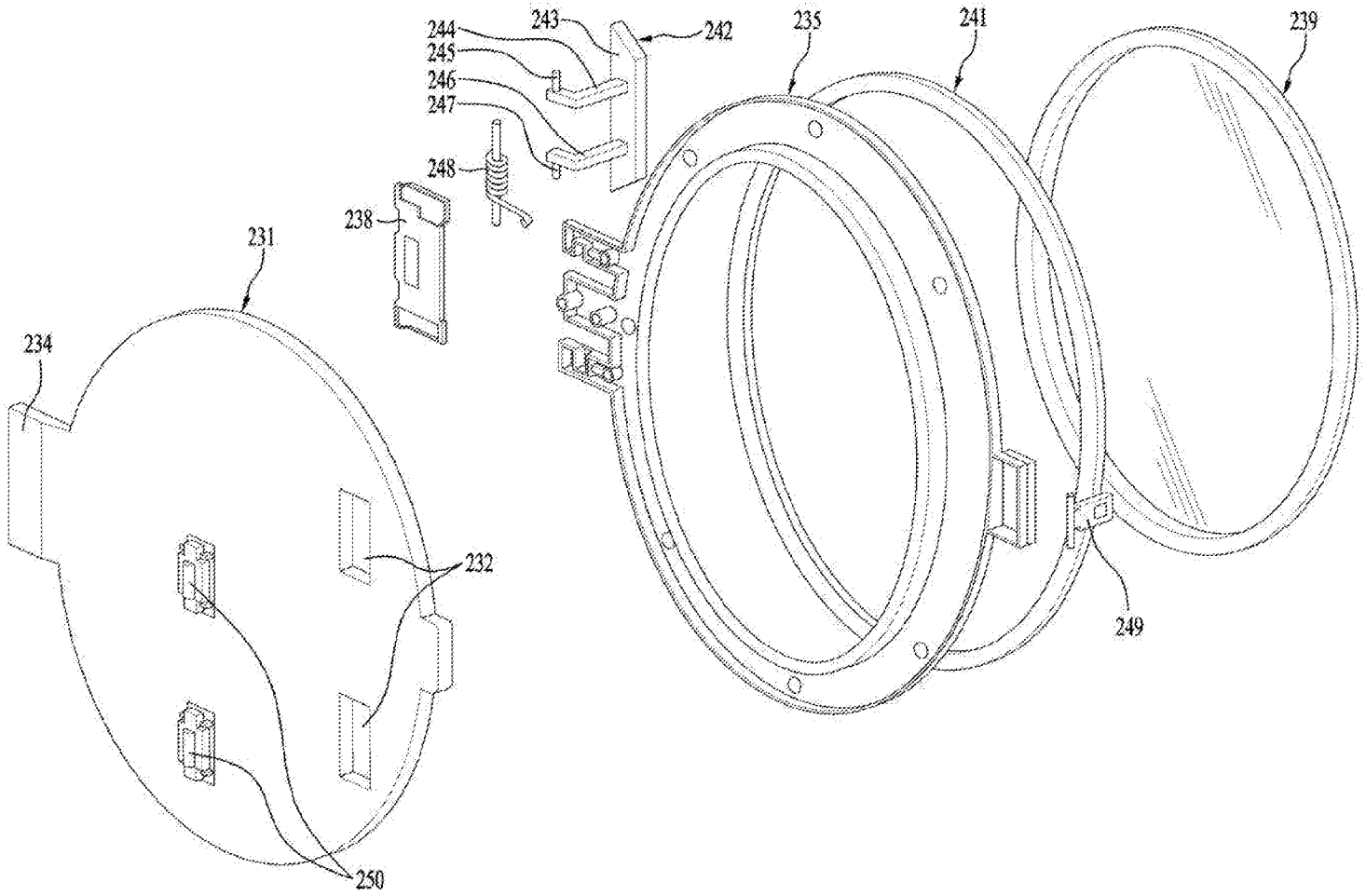
FIG. 9 is an exploded perspective view showing the tub door of the washing machine according to an embodiment of the invention.
Figure 10:
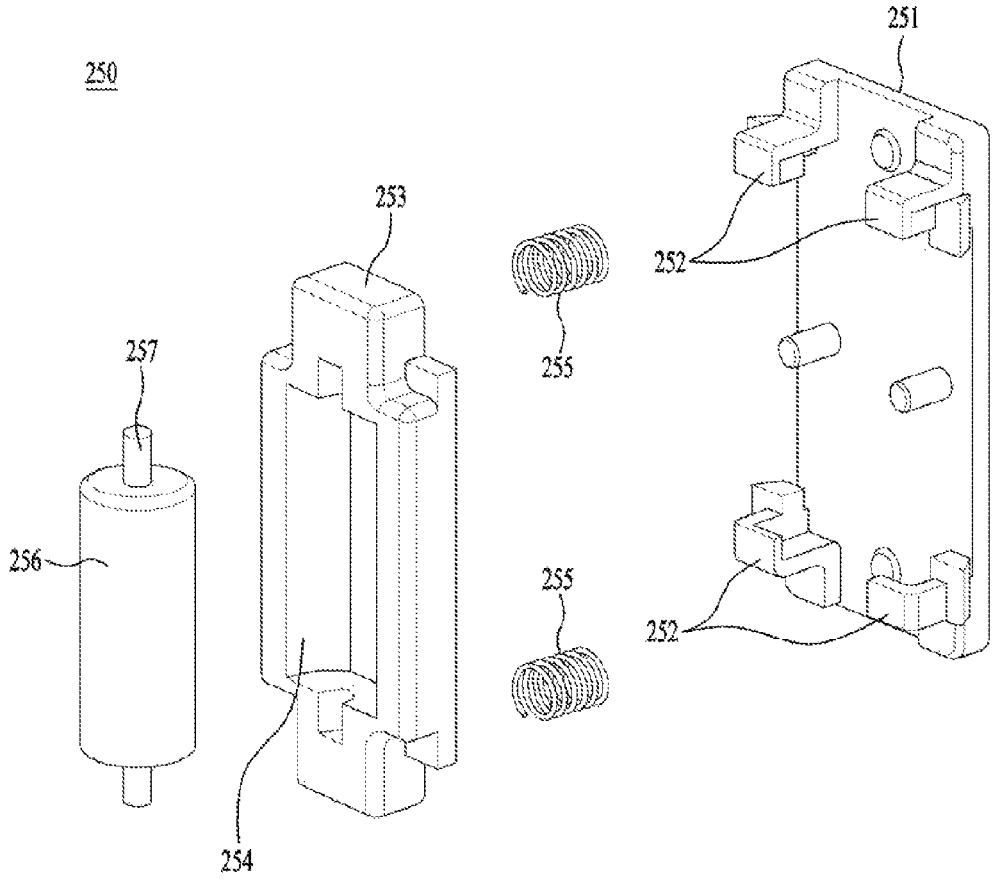
FIG. 10 is an exploded perspective view showing a push roller of the tub door of the washing machine according to an embodiment of the invention.

As shown in FIGS. 8 and 9, tub 200 is provided in the front thereof with second introduction port 210 for the insertion of laundry, second introduction port 210 being separated from first introduction port 114 of cabinet 100 and is concentrically positioned with respect to first introduction port 114. Tub 200 is provided with weight balancers 270, which are disposed radially outside second introduction port 210 to increase the mass of tub 200 to prevent or reduce the vibrations of tub 200. Tub 20 is provided at the periphery of second introduction port 210 with tub door 230 for opening and closing second introduction port 210 of tub 200, which is separate from cabinet 100.

Second introduction port 210, which is disposed at the front of tub 200, includes an annular rim 212, which protrudes toward front cabinet part 110. Annular rim 212 is provided at one lateral side thereof with a second hinge mount 214 on which second hinge unit 242 is mounted, and is provided at the other lateral side thereof with a tub door lock mount 216 on which tub door lock 260, for controlling the locked state of tub door 230, which is adapted to open and close second introduction port 210, is mounted.

Tub 200 is provided at one lateral side in the front thereof with the second hinge unit 242, which rotatably supports tub door 230 and enables tub door 230 to open and close second introduction port 210, and is provided at the other lateral side in the front thereof with the tub door lock 260 for controlling the locked state of tub door 230. Tub 200 is further provided at a position corresponding to tub door lock releaser pusher 146 of lock release unit 140 disposed in cabinet 110 and above tub door lock 260 with tub door lock releaser 220 for releasing the locked state of the tub door lock 260.

Tub door 230, tub door lock 260, the tub door lock releaser 220 are connected to cabinet 100, and tub 200 is supported by the suspension (not shown), independent of cabinet 100.

Unlike conventional washing machine 1, since only the suspension is disposed between tub 200 and cabinet 100, without gasket 9, and vibrations of the tub 200 are transmitted only to the suspension, it is possible to substantially reduce the transmission of vibration from tub 200 to cabinet 100.

Tub door 230 includes a second outer frame 231, which generally defines or delineates an outer face of tub door 230, an annular second inner frame 235, which generally defines or delineates an outer surface of tub door 230 and has a hole in the center thereof, an annular ring sealer 241, which is disposed between second outer frame 231 and second inner frame 235 to ensure a seal between second introduction port 210 of tub 200 and tub door 230, and a transparent frame 239, which is fitted in the hole in the center of second inner frame 235 so that the interior of tub 200 or drum 400 is visible.

Second inner frame 235 is provided at a lateral side thereof with a projection 236 to which second hinge unit 242 is coupled. Projection 236 includes recesses 237 in which upper and lower hinge rods 244 and 246 and a hinge spring 248 of second hinge unit 242 are received. Second inner frame 235 is provided at the other lateral side, opposite second hinge unit 242, and includes a tub door hook 249, which is fitted into the tub door lock 260 so as to maintain the locked state of tub door 230.

Second outer frame 231 is provided at a lateral side thereof with a projection 234 to cover projection 236 provided at second inner frame 235, and is provided at predetermined areas on the outer surface thereof with push rollers 250. The push rollers 250 contact roller-contacting surface 165 of cabinet door 160 disposed outside tub door 230 and push cabinet door 160 outward when tub door 230 is rotated in the opening direction.

Push rollers 250 also prevent cabinet door 160 or tub door 230 from being damaged due to friction between cabinet door 160 and tub door 230 when tub door 230 is opened by hinge spring 248 of second hinge unit 242.

Figure 11:
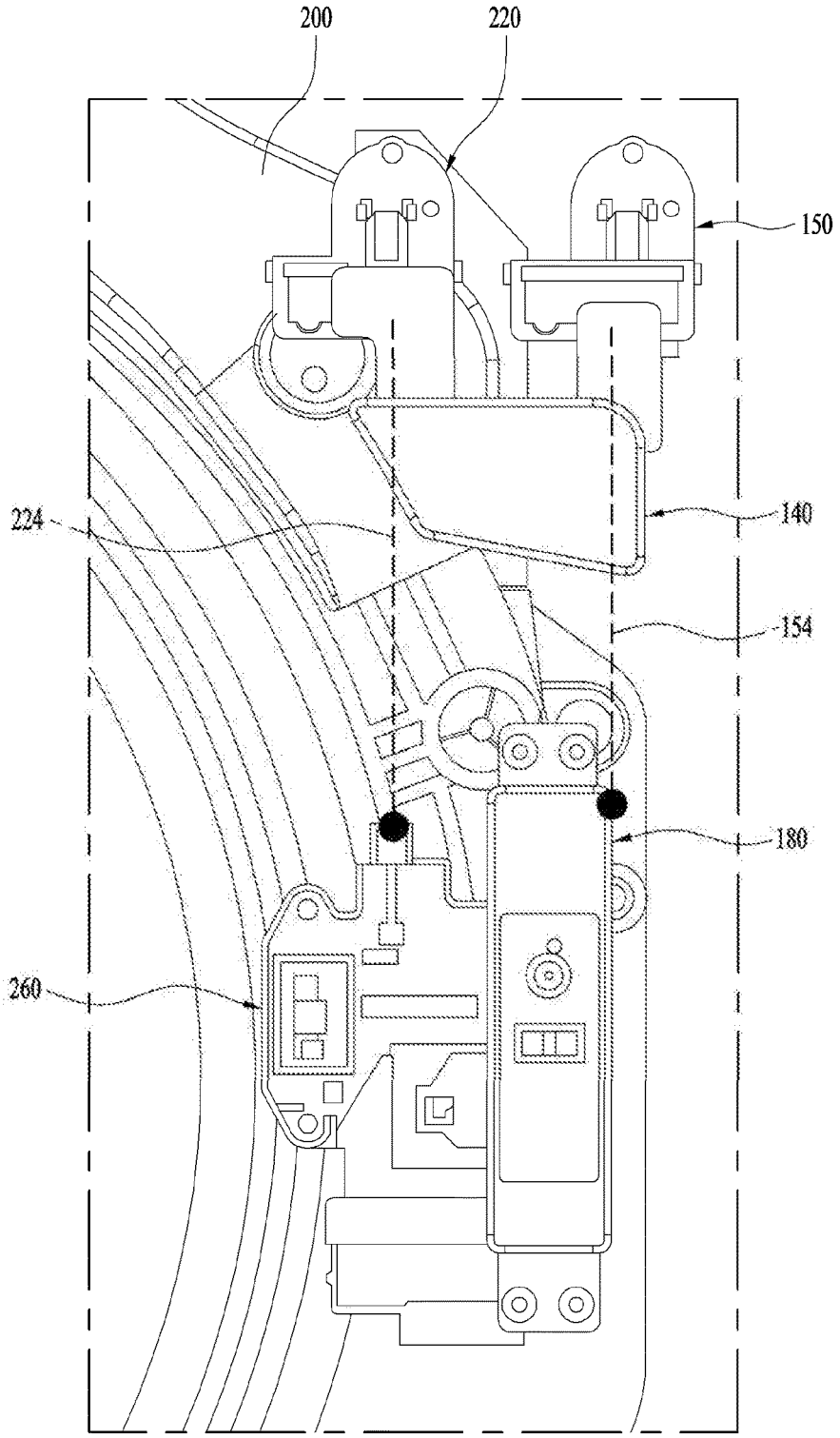
FIG. 11 is a front view showing the locking unit of the washing machine according to an embodiment of the invention.

As shown in FIG. 11, each of push rollers 250 includes a mounting base 251 fitted in a roller fitting portion 232 formed in second outer frame 231 of tub door 230, a movable member 253, which is movably coupled to mounting base 251 with a predetermined spacing therebetween, and a roller 256, which is provided in movable member 253 and has a rotating shaft 257 parallel to the rotating shafts of cabinet door 160 and tub door 230.

Mounting base 251 is provided at respective corners thereof with protrusions 252 for limiting the distance that movable member 253 can move. Since movable member 253 interferes with the limiting protrusions 252 of the mounting base 251, separation of movable member 253 from mounting base 251 is prevented.

Springs 255 are disposed between mounting base 251 and movable member 253 so that movable unit 253 is spaced apart from the mounting base 251 by a predetermined elastic force. Movable member 253 has a roller hole 254 in which roller 256 is rotatably mounted.

Accordingly, when tub door 230 is opened, push rollers 250 contact roller-contacting surface 165 formed on first inner frame 164 of cabinet door 160 and push out cabinet door 160 in the opening direction, thereby opening cabinet door 160.

Meanwhile, second hinge unit 242 is mounted on second hinge mount 214, which is provided at a lateral side of rim 212 of second introduction port 210 to rotatably support tub door 230 and to provide an elastic force to bias the tub door 230 in the direction in which second introduction port 210 is opened.

Second hinge unit 242 includes a hinge body 243 mounted on second hinge mount 214, upper and lower hinge rods 244 and 246, extending from upper and lower portions of hinge body 243, upper and lower hinge shafts 245 and 247, which are respectively provided at the ends of upper and lower hinge rods 244 and 246 and are rotatably received in recesses 237 in second inner frame 235, and hinge spring 248, which is disposed to have the same rotating axis as upper and lower rotating shafts 245 and 247 and provides tub door 230 with elastic force to bias tub door 230 in the direction in which tub door 230 is opened with respect to second introduction port 210.

Upper and lower hinge rods 244 and 246 of second hinge unit 242 are preferably configured to have therebetween a smaller spacing than the spacing between upper and lower hinge rods 171 and 173 of first hinge unit 168. First hinge unit 168 and second hinge unit 242 rotatably support cabinet door 160 and tub door 230 about different rotating shafts. Accordingly, to prevent the rotating shafts of first and second hinge units 168 and 242 from interfering with each other, the axes of the rotating shafts of first and second hinge units 168 and 242 are separated from and spaced apart from each other.

Tub door lock mount 216, which is provided at the other lateral side of second introduction port 210 of tub 200, is provided with tub door lock 260, on which tub door hook 249 of tub door 230 is fitted and locked. The door lock 216 is provided with tub door lock releaser 220, which releases the locked state of tub door lock 260 in response to an actuation of lock-releasing unit 140.

Tub door lock releaser 220, which is intended to release the locked state of tub door lock 260 by transmitting the actuating force, applied to lock-releasing unit 140, to tub door lock 260, includes a rotator 222, which is pressed by tub door lock releaser pusher 146 provided in lock-releasing unit 140 when push button 142 of lock-releasing unit 140 is pressed, and a tensile cable 224 to transmit the rotational force of rotator 222 to tub door lock 260 in response to rotation of rotator 222.

Tub door lock 260, which controls the locked state of tub door 230 and is mounted on second introduction port 210, includes hook-engaging portion 181, mounted on tub door lock mount 216 proximate to second introduction port 210, and a cable connector 261, connected to tensile cable 224 of the tub door lock releaser 220 proximate to hook-engaging portion 181.

Hereinafter, the operation of the washing machine according to an embodiment of the invention is described in detail with reference to the accompanying drawings. The components mentioned below should be understood in light of the above description and the accompanying drawings.

According to an embodiment of the invention, cabinet door hook 175 of cabinet door 160 is locked on cabinet door lock 180, and the locked state is maintained. Meanwhile, tub door hook 249 of tub door 230 is locked on tub door lock 260, and the locked state is maintained.

The operation of opening cabinet door 160 and tub door 230 is described with reference to the accompanying drawings.

Figure 12:
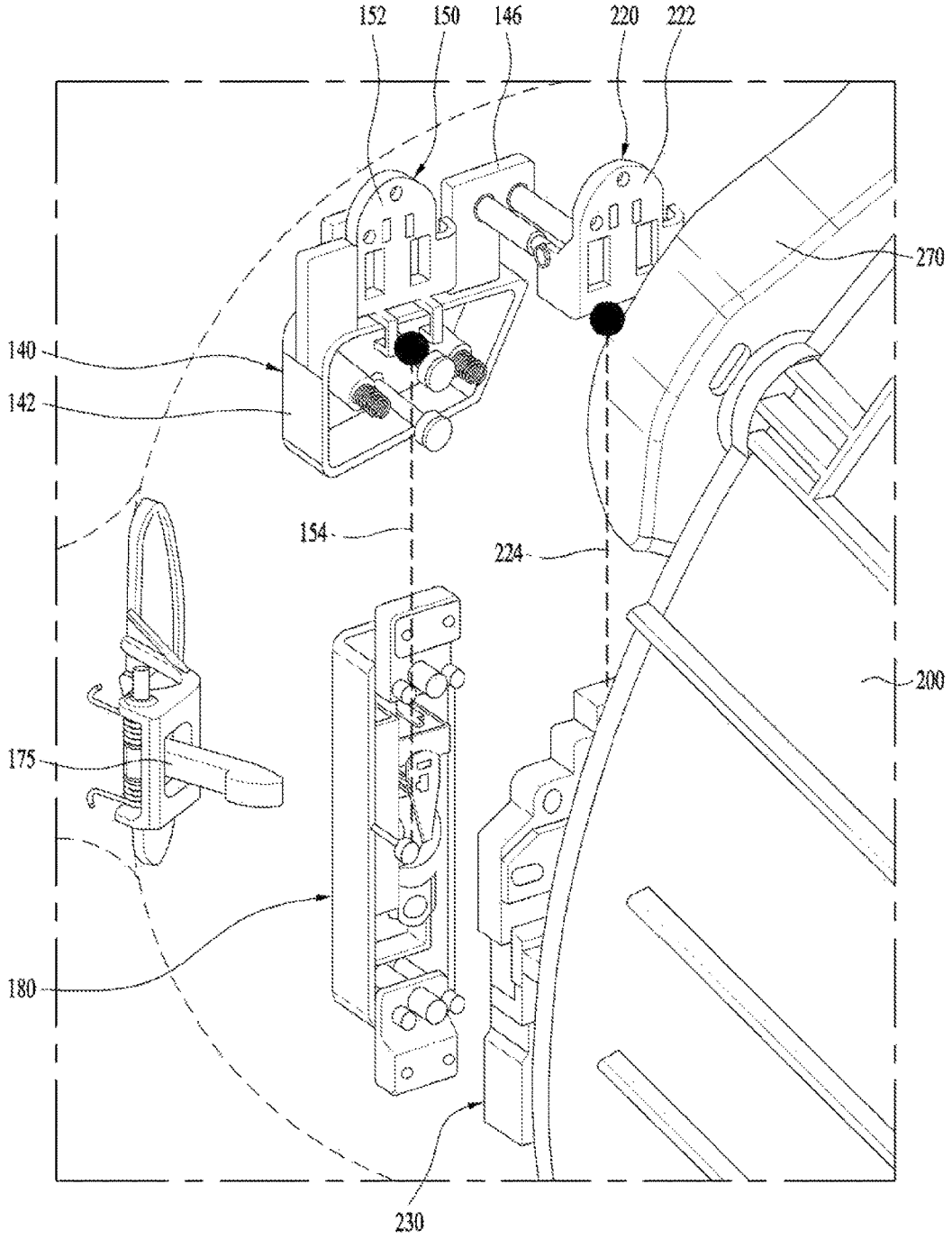
FIG. 12 is a rear perspective view showing the locking unit of the washing machine according to an embodiment of the invention.
Figure 13:
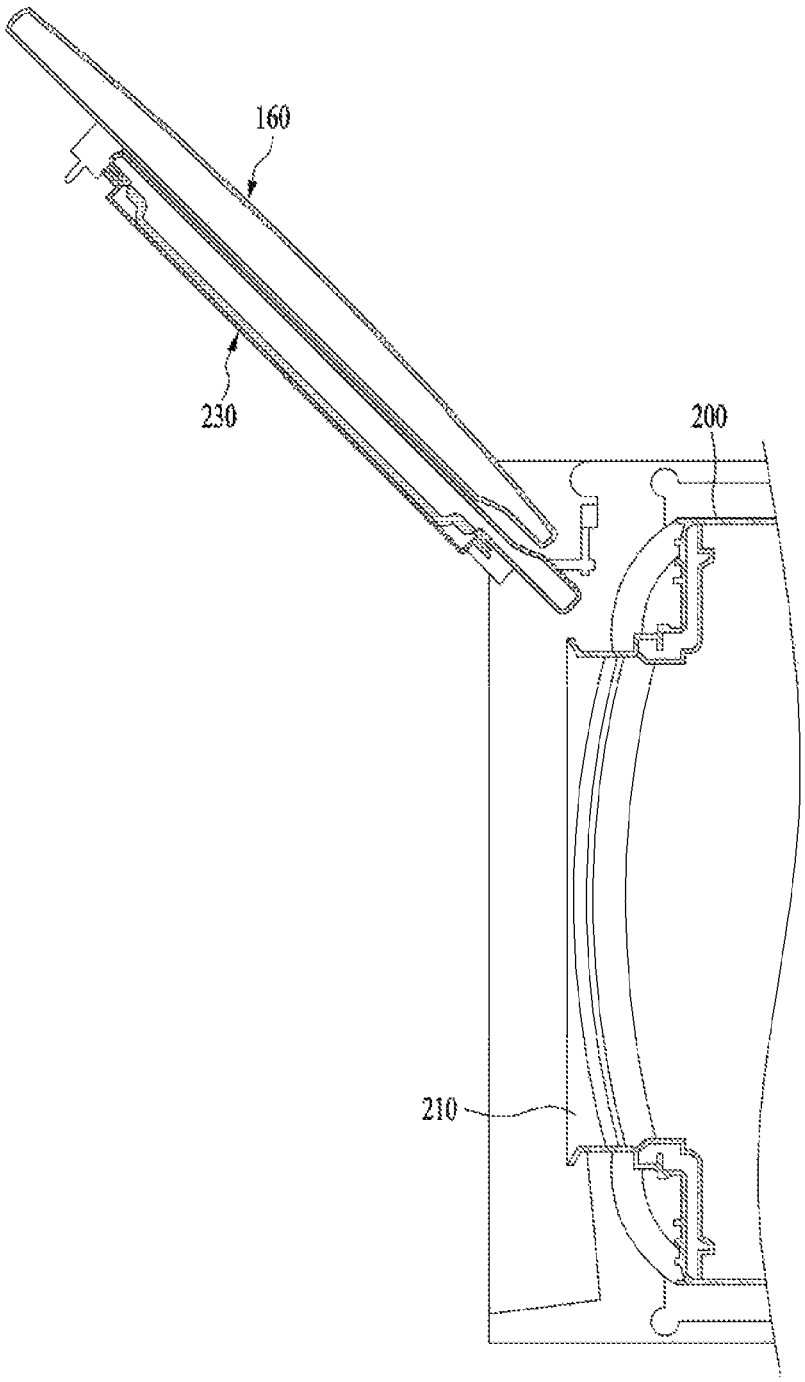
FIG. 13 is a plan cross-sectional view showing the opened state of the washing machine according to the invention.

FIG. 11 is a front view showing the lock unit of washing machine 1 according to an embodiment of the invention. FIG. 12 is a rear perspective view showing the lock unit of washing machine 1 according to an embodiment of the invention. FIG. 13 is a plan cross-sectional view showing the opened state of washing machine 1 according to an embodiment of the invention.

For example, in order for a user to open cabinet door 160 of washing machine 1, user pushes push button 142 of lock-releasing unit 140 provided in front cabinet part 110. Consequently, cabinet door lock releaser pusher 144 and tub door lock releaser pusher 146 of push button 142 push rotator 152 of cabinet door lock releaser 150 and rotator 222 of tub door lock releaser 220, respectively.

Accordingly, as rotator 152 of cabinet door lock releaser 150 is rotated, tensile cable 154 connected to rotator 152 of cabinet door lock releaser 150 is pulled, and cable connector 182 of cabinet door lock 180 is actuated by tensile cable 154 of cabinet door lock releaser 150, thereby releasing the locked state in which cabinet door hook 175 of cabinet door 160 engages with hook-engaging portion 181 of cabinet door lock releaser 150.

As the locked state of cabinet door 160 is released, rotator 222 of tub door lock releaser 220 is rotated, thereby pulling tensile cable 224 connected to rotator 222 of tub door lock releaser 220. Consequently, cable connector 261 of tub door lock 260 is actuated by tensile cable 224 of tub door lock releaser 220, and the locked state, in which tub door hook 249 of tub door 230 engages with hook-engaging portion 181 of tub door lock releaser 220, is released, thereby releasing the locked state of cabinet door 160 and tub door 230.

By the release of the locked state of cabinet door 160 and tub door 230, tub door 230 is rotated in the opening direction by hinge spring 248 provided in second hinge unit 242 of tub door 230, and push rollers 250, which are provided on second outer frame 231 of tub door 230, push roller-contacting surface 165 provided on first inner frame 168 of cabinet door 160 to open cabinet door 160, thereby opening tub door 230 and cabinet door 160 simultaneously.

Hereinafter, the operation of closing cabinet door 160 and tub door 230 is described with reference to the accompanying drawings.

Figure 14A:
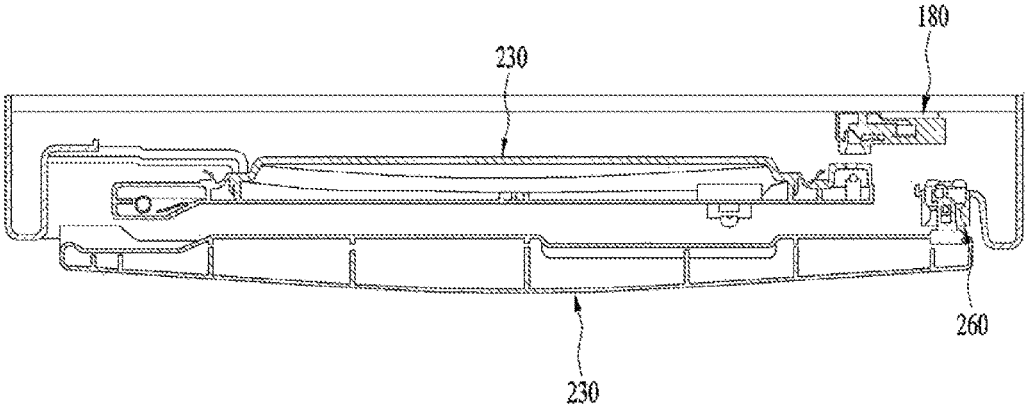
FIG. 14(*a*), FIG. 14(*b*) and FIG. 14(*c*) are each a plan cross-sectional view sequentially that together show a locking operation of the washing machine according to an embodiment of the invention.
Figure 14B:
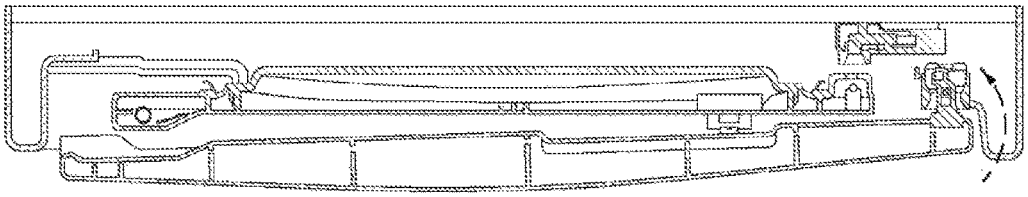
Figure 14C:
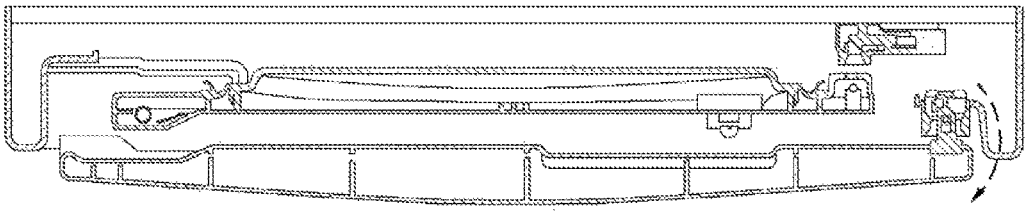

FIG. 14 is a plan cross-sectional view sequentially showing an operation of locking the washing machine 1 according to an embodiment of the invention.

As shown in the drawing, in the operation of closing cabinet door 160 and tub door 230, as the user rotates cabinet door 160 in closing direction, roller-contacting surface 165 provided on the first inner frame 168 of the cabinet door 160 contacts the push rollers 250 provided on second outer frame 231 of tub door 230, and cabinet door 160 and tub door 230 are thus rotated against the elastic force of hinge spring 248 provided in second hinge unit 242 of tub door 230.

Referring to FIG. 14(*a*), for example, as cabinet door 160 and tub door 230 are rotated, cabinet door hook 175 of cabinet door 160 is inserted into cabinet door lock 180, and tub door hook 249 of tub door 230 is simultaneously inserted into tub door lock 260.

Referring to FIG. 14(*b*), for example, when cabinet door hook 175 of cabinet door 160 is inserted into cabinet door lock 180 by the rotation of cabinet door 160, cabinet door hook 175 engages with cabinet door lock 180 as a result of pressure caused by the rotation of cabinet door 160. This occurs because hook insert portion 183, into which cabinet door hook 175 is inserted, is elastically supported by the springs. At this time, tub door 230 moves a distance corresponding to the distance that hook insert portion 183 of cabinet door lock 180 moves, and then engages with tub door lock 260.

Referring to FIG. 14(*c*), for example, when the pressure applied to cabinet door 160 by the user is released, hook insert portion 183 of cabinet door lock 180 is restored to the normal position by the elastic force of the springs supporting hook insert portion 183, and cabinet door 160, engaging with the cabinet door lock 180, is restored to the position spaced apart from tub door 230 by the restoring force of hook insert portion 183, thereby completing the operation of closing cabinet door 160 and tub door 230.

Accordingly, because cabinet door 160 and tub door 230 are spaced apart from each other when they are closed, the direct transmission of vibrations from tub 200 to cabinet 100 during the washing operation is prevented.

As is apparent from the above description, according to embodiments of the invention, the transmission of vibrations and noise from the tub to the cabinet is prevented by improving the structure between the tub and the cabinet, and vibrations and noise generated by the cabinet are thus reduced. Therefore, unpleasant vibrations and noise are prevented.

Furthermore, according to an embodiment of the invention, the improved structure between the tub 200 and the cabinet 100 increases the capacity of the tub 200.

It will be apparent to those skilled in the art that various modifications and variations can be made to the embodiments of the invention discussed herein without departing from the spirit or scope of the inventions. Thus, it is intended that the presently disclosed invention cover the modifications and variations of this invention provided they come within the scope of the appended claims and their equivalents.

What is claimed is:

1. A washing machine comprising:

a cabinet including a first cabinet part having a first introduction port formed at a front side thereof;

a tub provided in the cabinet, and having a second introduction port that is a concentric position with respect to the first introduction port;

a cabinet door attached to the cabinet to rotate forward to open and close the first introduction port;

a cabinet door lock provided on the front cabinet part to set a lock state of the cabinet door;

a tub door attached to the tub to rotate in a direction parallel to a rotation direction of the cabinet door to open and close the second introduction port;

a tub door lock provided at a front side of the tub to set a lock state of the tub door;

a lock-releasing unit provided on the first cabinet part to simultaneously unlock the cabinet door lock and the tub door lock;

a cabinet door lock releaser that is actuated by the lock-releasing unit to unlock the cabinet door lock; and a tub door lock releaser that is actuated by the lock-releasing unit to unlock the tub door lock.

2. The washing machine according to claim 1, wherein the cabinet door comprises a first hinge unit having a first rotating shaft, and the tub door comprises a second hinge unit having a second rotating shaft that is spaced apart from the first rotating shaft.

3. The washing machine of claim 1, wherein the tub door is elastically biased in an opening direction of the second introduction port.

4. The washing machine of claim 3, wherein the tub door is opened in conjunction with the cabinet door when the cabinet door is opened.

5. The washing machine of claim 1, wherein the tub door is closed in conjunction with the cabinet door when the cabinet door is closed.

6. The washing machine of claim 1, wherein the cabinet door lock comprises:

a hook-engaging portion provided in a front cabinet part of the cabinet;

a hook insert portion coupled to the hook-engaging portion in a manner of being movable in the direction in which cabinet door is closed, an elastic support to elastically support the hook insert portion in the direction opposite to the direction of close of cabinet door.

7. The washing machine of claim 1, wherein the lock-releasing unit further comprises:

a push button provided at the first cabinet part for simultaneously operating the cabinet door lock releaser and the tub door lock releaser.

8. The washing machine of claim 1, wherein the cabinet door lock releaser is provided at the cabinet, and the tub door lock releaser is provided at the tub.

9. The washing machine of claim 1, wherein the tub door is hingedly attached to the tub, and the tub comprises a hinge unit to exert an elastic force in an opening direction of the second introduction port.

10. The washing machine of claim 9, wherein the tub door includes a push roller provided on an outer surface of the tub door to push against the cabinet door.

11. The washing machine of claim 1, wherein the tub includes a tub door lock to lock the tub door, and the tub door lock locks the tub door by rotation of the cabinet door in a closing direction.

12. The washing machine of claim 11, wherein the cabinet comprises a cabinet door lock to keep the cabinet door in a locked state, and wherein the tub door lock locks the tub door after the cabinet door is locked by the cabinet door lock.

13. The washing machine of claim 12, wherein the cabinet door lock moves the cabinet door so that the cabinet door is spaced apart from the tub door after the tub door is locked.

14. The washing machine of claim 1, wherein the cabinet door lock is connected to the cabinet door lock releaser via a first tensile cable, and tub door lock is connected to the tub door lock releaser via a second tensile cable.

15. The washing machine of claim 14, wherein the cabinet door lock comprises:

a hook-engaging portion attached to the cabinet to lock the cabinet door;

an elastic support that is elastically supported by the hook-engaging portion in an opening direction of the cabinet door; and a connector attached to the first tensile cable to unlock the cabinet door.

16. The washing machine of claim 14, wherein the tub door lock comprises:

a hook-engaging portion attached to the tub to lock the tub door; and a connector attached to the second tensile cable to unlock the tub door.

* * * * *